US007235019B1

(12) United States Patent
LeCher

(10) Patent No.: US 7,235,019 B1
(45) Date of Patent: Jun. 26, 2007

(54) STABILIZING BRACKETS FOR DESIGNING AND CONSTRUCTING A SWING SET/PLAY SET SYSTEM

(76) Inventor: Noel LeCher, 28 Mountain Trail Ct., Cartersville, GA (US) 30120

( * ) Notice: Subject to any disclaimer, the term of this patent is extended or adjusted under 35 U.S.C. 154(b) by 392 days.

(21) Appl. No.: 10/982,681

(22) Filed: Nov. 8, 2004

Related U.S. Application Data

(60) Provisional application No. 60/520,484, filed on Nov. 17, 2003.

(51) Int. Cl.
*A63G 9/00* (2006.01)

(52) U.S. Cl. ..... 472/118; 403/217; 482/35

(58) Field of Classification Search ..... 472/118–125; 403/217, 403; 482/35, 36
See application file for complete search history.

(56) References Cited

U.S. PATENT DOCUMENTS 1,719,440 A * 7/1929 Nathan ..... 5/130
3,423,898 A * 1/1969 Coloney et al. ..... 52/713
4,572,695 A * 2/1986 Gilb ..... 403/232.1
4,897,979 A * 2/1990 Colonias ..... 52/643
4,966,309 A 10/1990 Baer
5,016,873 A * 5/1991 Bossa ..... 472/118
5,150,982 A * 9/1992 Gilb ..... 403/232.1
5,364,312 A 11/1994 Cunard et al.
5,377,780 A * 1/1995 Dunaway ..... 182/185.1
5,412,920 A * 5/1995 Hess ..... 52/712
5,560,156 A * 10/1996 McDonald ..... 52/92.2
5,797,694 A * 8/1998 Breivik ..... 403/231
6,022,165 A * 2/2000 Lin ..... 403/231
6,302,801 B1 * 10/2001 Zeilinger ..... 472/118
6,527,232 B2 3/2003 Robertson et al.

* cited by examiner

*Primary Examiner*—Kien Nguyen
(74) *Attorney, Agent, or Firm*—William B. Noll

(57) ABSTRACT

A customized swing set/play set system, and kit of components containing a pair of assembly brackets, where the assembly may be readily erected by a do-it-yourself handyman. The system, is for use in conjunction with a supply of wooden lumber products, which includes a pair of 4×4 leg supports, a 4×4 beam, and a wall panel section. A first bracket includes a pair of channel shaped sections extending angularly from an intermediate channel section. The second bracket includes a planar face plate and a pair of upstanding tabs extending generally perpendicular thereto.

8 Claims, 5 Drawing Sheets

STABILIZING BRACKETS FOR DESIGNING AND CONSTRUCTING A SWING SET/PLAY SET SYSTEM

RELATED APPLICATION

This application is related to and claims priority of Provisional Application, Ser. No. 60/520,484, filed Nov. 17, 2003, under the same title and by the inventor hereof, where the contents thereof are incorporated herein by reference in its entirety.

FIELD OF THE INVENTION

This invention is directed to the field of back yard play gyms and swing sets, more particularly to stabilizing brackets useful to the builder of such play gyms and swing sets in designing a personalized system for the individuals to be using same, and to constructing such a personalized system.

BACKGROUND OF THE INVENTION

The present invention relates to system comprising plural stabilizing brackets, and to a kit of components therefore, for use in designing and constructing an outdoor play gym, swing set, or play set, of the type often found in the back yard of homes, especially those with small children. The brackets are designed and constructed to allow the home owner to personalize the design to include such features as swings, teeter totter boards, elevated platforms, slides, etc., where the selected features will depend on the ages of the children to be using same.

Most of the back yard sets that are found in residential neighborhoods are commercial systems available in many retail outlets and typically consist of an A-frame formed of tubular products, with swings and a teeter totter board suspended from a cross member of a tubular configuration. Further, such commercial systems are held in place with either complicated braces or just simply nails. These fastening mechanisms can lead to instability that may result in injuries or potential dangerous conditions. In any case, personalized systems are not commercially available, and should one design an individualized system, little help can be found from the commercial outlets in finding the fastening members and supports that are needed.

What may be available in the prior art are limited in the freedom to design a personalized system. Several patents from the prior art are found in the following U.S. Patents:

a.) No. 6,527,232, to Robertson et al., discloses an A-frame bracket having a rectangular top, and two rectangular side walls that each extend at an angle downwardly from the rectangular top, wherein each side wall has an integrally formed flange forming an "L"-shaped wall for receiving wooden legs that form an A-frame.

b.) No. 5,364,312, to Cunard et al., relates to a kit for assembling wood legs to form an A-frame to support the end of a cross beam for a children's play gym that includes a trapezoidal frame bracket to connect the upper ends of the legs to each other and to the cross beam and a special frame brace for reinforcing that connection which will accommodate a tubular metal cross beam or a cross beam consisting of a single board or a plurality of boards. The frame brace has a generally rectangular top wall and a pair of laterally spaced apart side walls extending down from the top wall at an angle such that the side walls have more or less the same slope as the side edges of the frame bracket. Portions of the frame brace top wall define a first set of holes spaced apart along the longitudinal centerline of the top wall, there being two such holes in the first set and a second set of holes containing at least two holes spaced along the top wall on each side of that centerline. There also may be a third set of holes containing at least two holes spaced along the top wall on each side of the centerline and being displaced from the second set of holes. The kit also includes fasteners arranged to extend through the first set of holes into the cross beam when the cross beam is a unitary member and through the second and third sets of holes into the cross beam when the cross beam is of wood so that the same hardware can be used to construct play gyms having a variety of different type cross beams.

c.) No. 4,966,309, to Baer, teaches a kit for assembling timbers into a play structure. The kit includes a frame bracket which has a frame segment joined at a right angle to a beam segment. The frame segment has four nail or screw holes and the beam segment has two nail or screw holes. The beam segment has a square bolt hole for receiving a carriage bolt. The frame segment is adapted to joining two timbers into an A-frame so formed to a transverse overhead laminated beam. The kit also has a frame brace with a body plate having a flange joined to it at such an angle that when the body is placed flat on the A-frame, the flange lies flat on the beam. The frame brace has nail or screw holes and bolt holes in both the body and the flange. The kit also contains rectangular flat beam clamps adapted to attachment across the laminations of the beam so as to restrict the separating of the laminations. The beam clamps have at least two nail holes and a central bolt hole. The bolt hole being circular on the beam clamp for use with the frame bracket and oblong for use with a swing hanger.

While the foregoing prior art offer some insight into the construction of gym sets, such as for the back yard, they fail to offer a readily constructable system that allows for the do-it-yourselfer to build and assemble a customized set in the manner of the present invention. The manner by which the present invention allows the do-it-yourselfer to accomplish his goals will become clearer in the following specification and drawings.

SUMMARY OF THE INVENTION

This invention is directed to a system composed of a plurality of stabilizing brackets to be used by a do-it-yourself handyman to design and construct a swing set/play set system that allows the handyman to personalize a system that best suits the needs and challenges of different age group children, and to a kit of components for constructing such system. The invention teaches two different bracket constructions to give versatility in the design and construction thereof. Specifically, the brackets include:

a.) a one-piece metal blank, stamped and formed into an A-frame end support bracket featuring a pair of channel sections, angled relative to one another, for receiving complementary leg members, preferably conventional 4×4 wooden posts, and a separating channel member for receiving a cross beam member, such as a conventional 4×4 wooden post; and, b.) a one-piece metal blank, stamped and formed into a bracket for attaching an A-frame cross beam to an elevated platform, such as a play fort, where the bracket includes a planar base for securing to the elevated platform, and a pair of upstanding tabs from the base for attaching to the cross beam.

Accordingly, a feature of the invention is the provision of a system for readily constructing and assembling a play set/swing set by the use of prefabricated brackets, and to a kit of components for said system.

Another feature hereof lies in the ability to construct a customized play set/swing set that includes a bracket for attaching a pair of wooden beam leg supports at one end of an elevated cross beam, while the opposite end of the cross beam includes a unique bracket for mounting an elevated platform.

Still a further feature of the invention lies in the use of a pair of specially designed brackets stamped and formed from a flat, sheet meat blank.

These and other features of the invention will become more apparent in the description which follows, especially when read in conjunction with the accompanying drawings.

DETAILED DESCRIPTION OF PREFERRED EMBODIMENTS

Figure 1:
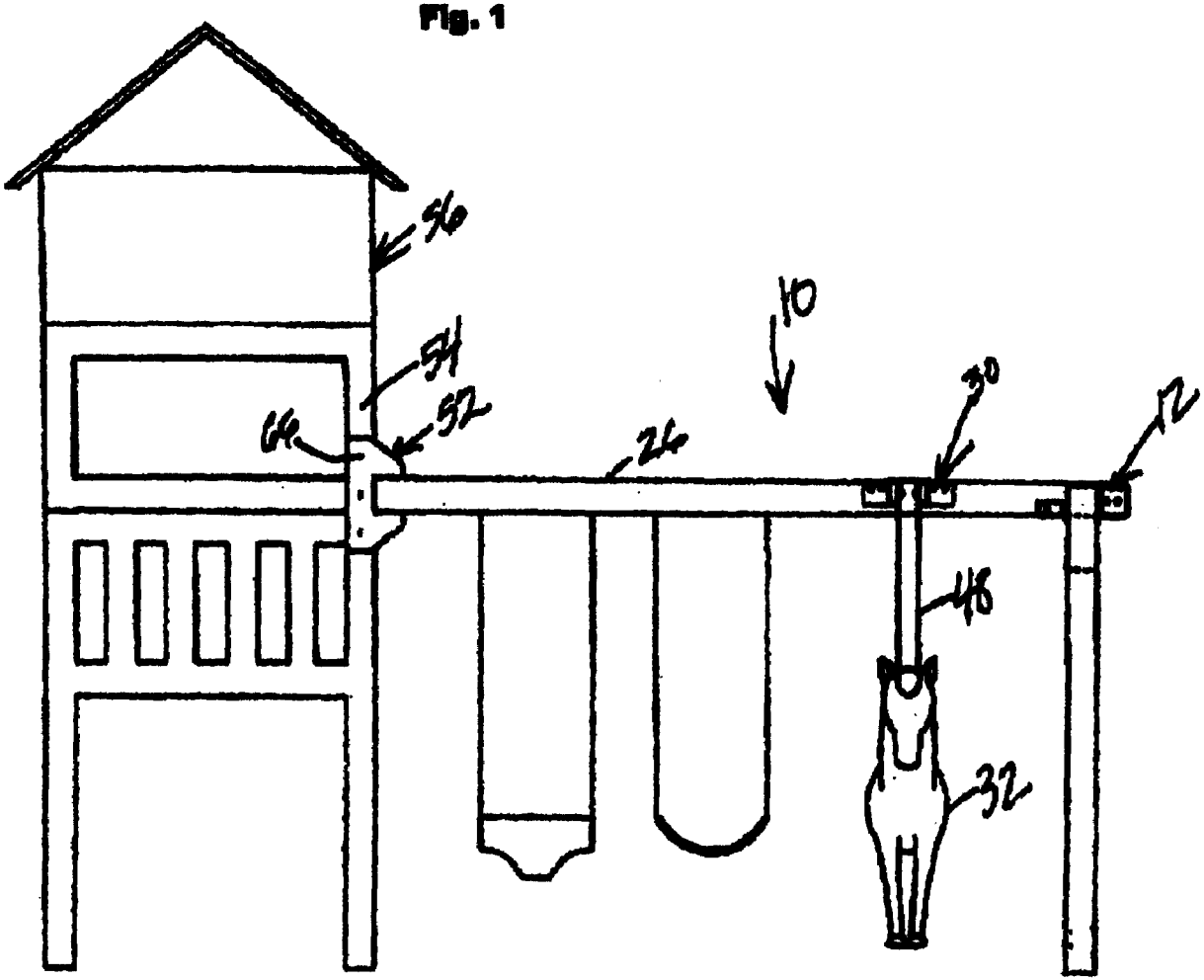
FIG. 1 is a simplified front view showing the use and placement of the plural stabilizing brackets for a personalized swing set according to the present invention.

This invention discloses design system aids in constructing a personalized swing set, gym set, and the like for particular use by do-it-yourself handymen in building a back yard swing set assembly. The various aids include plural one-piece metal blanks, such as steel, preferably galvanized steel, that are stamped and formed into different shaped brackets, where all the brackets are designed to be used with conventional 4×4 wooden posts, a typical product for use in supporting such assemblies. As known in the art, such wooden posts have a dressed size of about 3⅝ inches per side. The invention will now be described with regard to the several Figures, where like reference numerals represent like components or features throughout the various views.

Turning first to FIG. 1, there is illustrated an exemplary swing set assembly 10, utilizing the plural unique brackets of this invention, having a generally A-frame construction, right side, an elevated platform, in the form of a play fort, left side, and plural swings in the middle.

Figure 2:
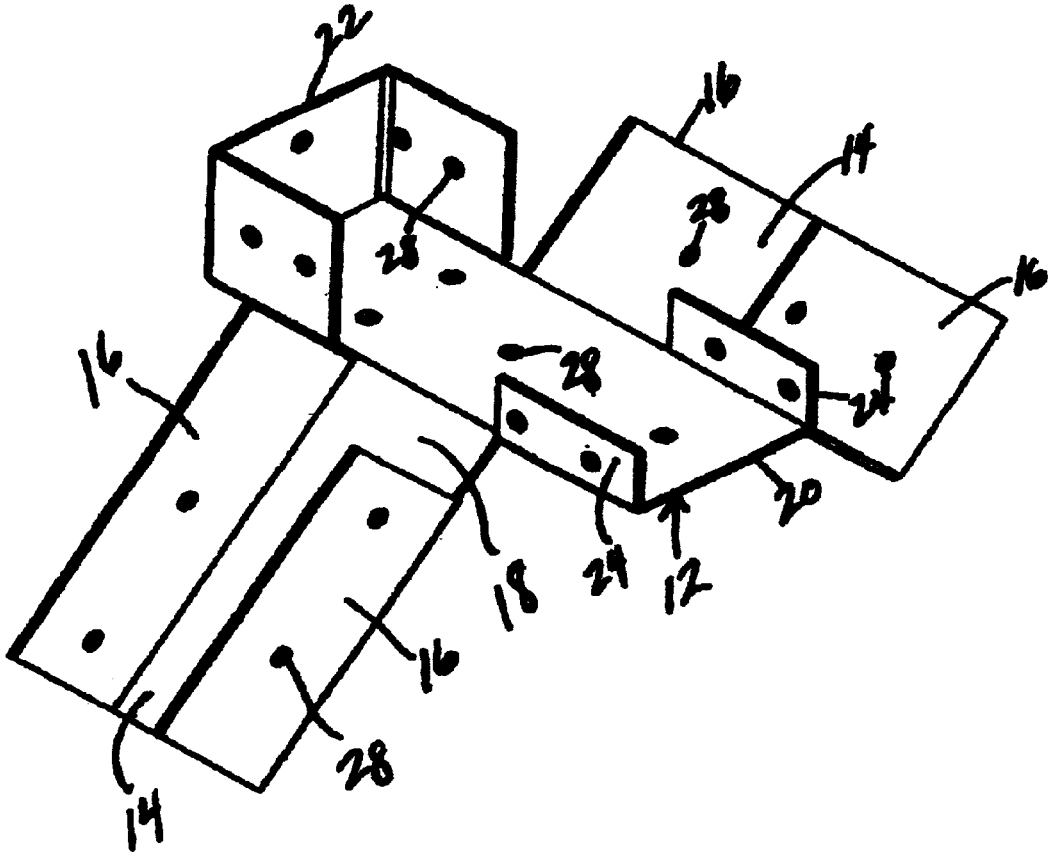
FIG. 2 is a perspective view of a first stamped and formed metal stabilizing bracket for the personalized swing set hereof, where the first bracket is used to attach a pair of support legs and cross beam.
Figure 3:
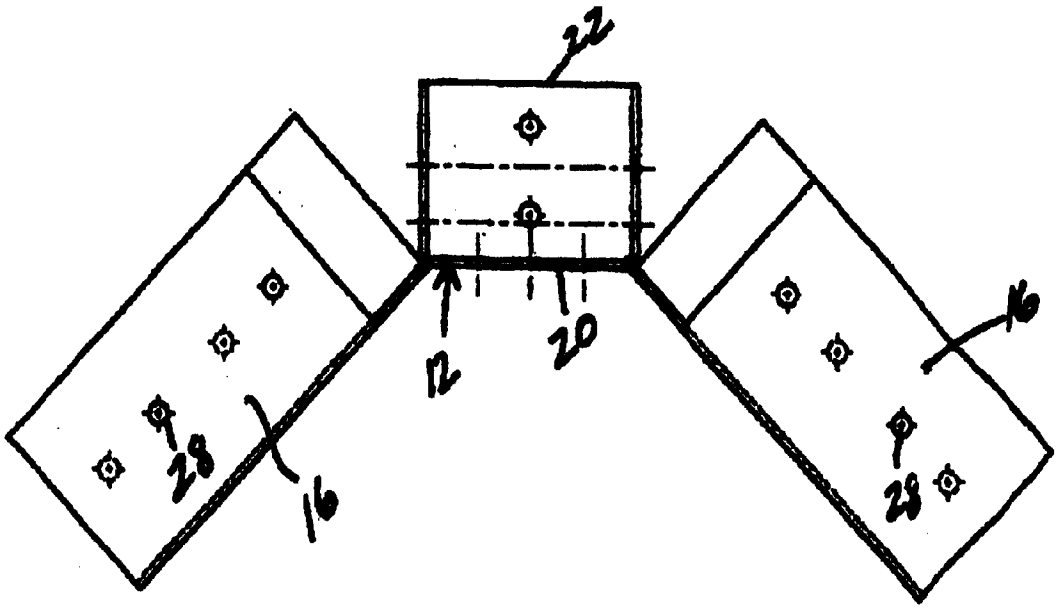
FIG. 3 is a right end view of the first bracket of FIG. 2.

FIGS. 2 and 3 illustrate a first bracket 12 of the invention, where the bracket is stamped and formed from a sheet metal blank, such as galvanized steel. The resulting first bracket features a pair of U-shaped channels 14, angled to one another, to slidably engage a 4×4 wooden post, where the channels 14 include a pair of side walls 16 and a base 18, see also FIG. 1. Additionally, joined to said U-shaped channels 14 is a cross beam channel member 20 that is characterized by a three walled closed end 22, and a pair of upturned forward tabs 24 for slidably engaging said cross beam 26, see also FIG. 1. Note that the respective elements forming the three channel members include a series of openings 28 to allow nailing of the bracket to the received wooden posts.

Figure 4:
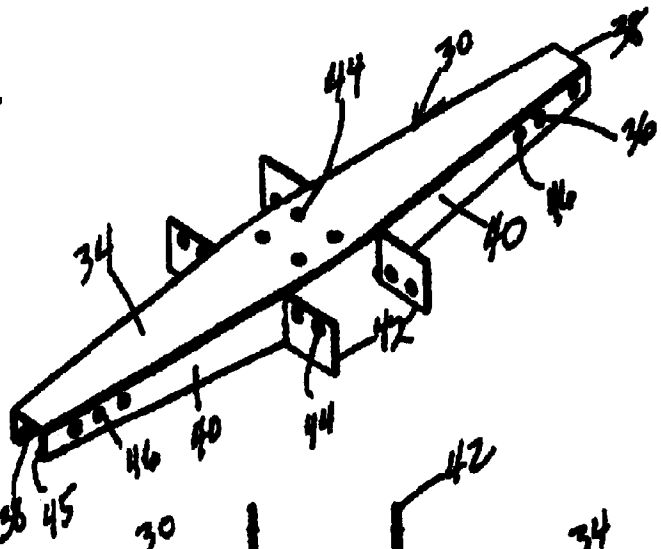
FIG. 4 is a perspective view of a second stamped and formed metal stabilizing bracket for the personalized swing set hereof, where the second bracket may be used to transversely mount a suspended hobby horse, by way of example, said bracket being the subject of a companion application.
Figure 5:
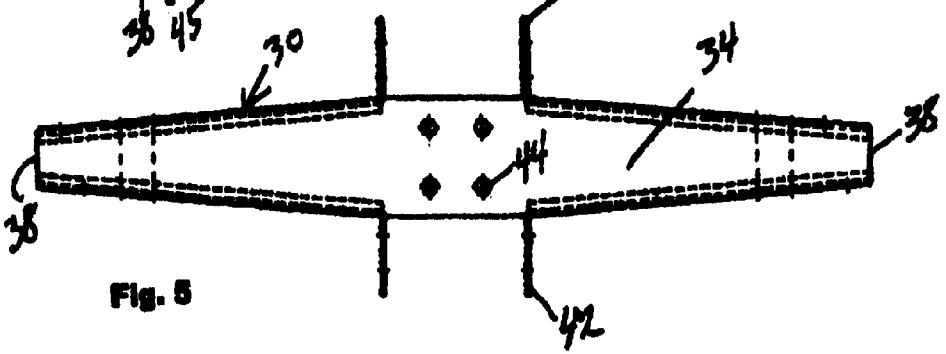
FIG. 5 is a bottom view of the second bracket of FIG. 4.

FIGS. 4 and 5 illustrate an accessory bracket 30 for use with the A-frame mounting brackets of this invention, where the bracket is also stamped and formed from a sheet metal blank. The formed accessory bracket 30, as noted in FIG. 1, may be used to suspend a swing like accessory, such as a hobby horse 32. The accessory bracket 30 comprises a planar base 34 with the edges 36 converging toward the ends 38. Upstanding from the edges 36 are wall sections 40, where the four wall sections 40 feature an outturned tabs 42. As best seen in FIG. 4, such tabs form a pair of spaced apart, aligned tabs sized to sidably engage the 4×4 cross beam 26. That is, the accessory bracket 30 is mounted transverse to the cross beam 26. To facilitate said mounting, the center of said base 34 and tabs 42 are provided with plural openings 44 for nailing the second bracket to the cross beam 26. Finally, in proximity to the ends 38, a pair of aligned apertures 46 are provided for suspending a rope or chain 48 (FIG. 1) to secure the swing accessory 50.

Figure 6:
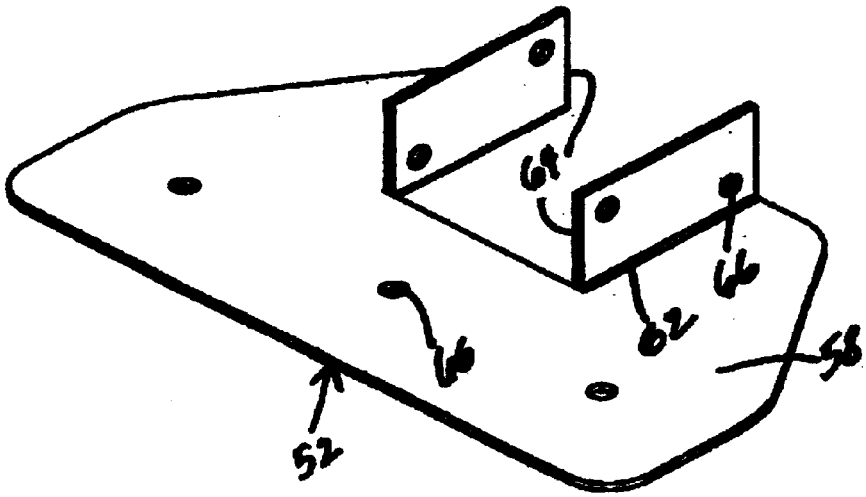
FIG. 6 is a perspective view of a third stamped and formed metal stabilizing bracket for the personalized swing set hereof, where the third bracket may be used to attach the cross beam to an elevated platform, such as a play fort.
Figure 7:
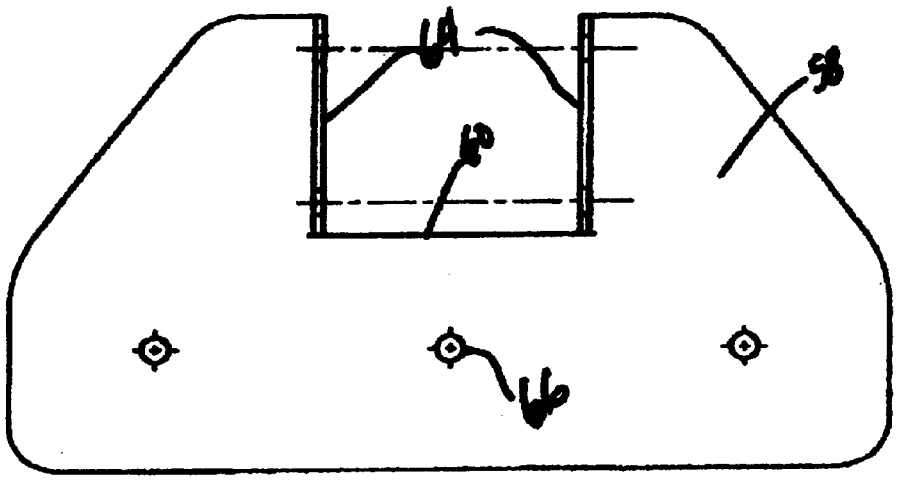
FIG. 7 is a top view of the third bracket of FIG. 6.

FIGS. 6 and 7 illustrate another bracket 52 of the invention, where the bracket 52 is also stamped and formed from a sheet metal blank. As seen in FIG. 1, one or a pair of said another brackets may be used for mounting the cross beam 26 to a wall 54, where the latter may form part of an elevated platform 56, such as a play fort. The bracket 52 comprises a planar base 58 with a slotted opening 60, where the sides 62 of the opening include a pair of upraised tabs 64. As with the first and second brackets described above, the spacing between the tabs 64 is sized to sidably engage a conventional 4×4 wood beam, in this case the cross beam 26. Further, the tabs 64 and planar base 58 are provided with a series of openings 66 for nailing the bracket 52 to the wall 54 and cross beam 26. In use, the planar base 58 lies contiguous to the wall 54, while the spaced apart tabs 64 straddle the cross beam 26.

It is contemplated that variations, modifications and changes may be made to one or more of the unique bracket members hereof, especially by those skilled in the art, without departing from the spirit and scope of the invention. Accordingly, no limitation is intended to be imposed thereon except as set forth in the accompanying claims.

I claim:

1. A swing set/play set system for assembly on the ground, where the system includes a pair of wooden 4×4 leg supports for supporting at a first end to a wooden 4×4 beam to be supported in spatial relationship to said ground, and a second end of said beam mounted to an upstanding platform, where said platform includes a wall section facing toward said first end, said system further including:

a. a first one-piece metal bracket, stamped and formed from a sheet metal blank, said first bracket having a pair of channel shaped sections with each receiving and securing one of said 4×4 leg support, and an intermediate channel section for receiving and securing to said first end of said beam; and, b. a second one-piece metal bracket, stamped and formed from a sheet metal blank, said second bracket having a planar face section for mounting and securing to said wall section, and a pair of upstanding tabs extending generally perpendicular to said planar face section, where said tabs are spaced apart for mounting and securing to said second end of said beam.

2. The swing set/play set system according to claim 1, wherein said channel shaped sections extend angularly from said intermediate channel section.

3. The swing set/play set system according to claim 2, wherein said intermediate channel section includes a U-shaped end portion for sliding engagement with said beam.

4. The swing set/play set system according to claim 3, wherein said intermediate channel section includes a pair of upstanding tabs at the opposite end of said intermediate channel section for engaging said beam.

5. The swing set/play set system according to claim 4, wherein said upstanding tabs, and said U-shaped end portion, include plural apertures for receiving plural fastening members to secure same to said beam.

6. The swing set/play set system according to claim 5, wherein said channel shaped sections include plural apertures for receiving plural fastening members to secure same to a respective said leg support.

7. The swing set/play set system according to claim 1, wherein said planar face section includes plural apertures for receiving plural fastening members to secure same to said wall.

8. The swing set/play set system according to claim 7, wherein said tabs include plural apertures for receiving plural fastening members for securing same to said beam.

* * * * *